US005421487A

United States Patent [19]

Moretti

[11] Patent Number: 5,421,487

[45] Date of Patent: Jun. 6, 1995

[54] DISPENSER CAP FOR A FLUID SUBSTANCE CONTAINER, WITH A MOVABLE DISPENSING NOZZLE

[75] Inventor: Remo Moretti, Capergnanica, Italy

[73] Assignee: Lumson S.r.l., Capergnanica, Italy

[21] Appl. No.: 136,871

[22] Filed: Oct. 18, 1993

[30] Foreign Application Priority Data

Oct. 27, 1992 [IT] Italy ..... MI92A2455
Jan. 13, 1993 [IT] Italy ..... MI93A0028

[51] Int. Cl.[6] ..... B67D 5/32
[52] U.S. Cl. ..... 222/153.1; 222/521
[58] Field of Search ..... 222/520, 521, 525, 153, 222/519, 523, 524

[56] References Cited

U.S. PATENT DOCUMENTS

| | | | |
|---|---|---|---|
| 1,913,807 | 6/1933 | Jones | 222/521 X |
| 3,439,843 | 4/1969 | Corsette . | |
| 3,809,299 | 5/1974 | Sand . | |
| 4,570,825 | 2/1986 | Stull | 222/521 X |
| 4,690,304 | 9/1987 | Morel | 222/521 X |
| 4,779,764 | 10/1988 | Debetencourt | 222/521 X |
| 4,805,807 | 2/1989 | Perne et al. | 222/153 |
| 5,004,127 | 4/1991 | Morel | 222/521 |
| 5,104,008 | 4/1992 | Crisci | 222/153 |
| 5,111,977 | 5/1992 | Maguire et al. | 222/521 |

FOREIGN PATENT DOCUMENTS

| | | | |
|---|---|---|---|
| 0187567 | 7/1986 | European Pat. Off. . | |
| 0270134 | 6/1988 | European Pat. Off. . | |
| 2488855 | 2/1982 | France . | |
| 1536330 | 1/1970 | Germany | 222/520 |
| 2644947 | 4/1978 | Germany . | |

*Primary Examiner*—Andres Kashnikow
*Assistant Examiner*—Lisa Douglas
*Attorney, Agent, or Firm*—Oblon, Spivak, McClelland, Maier & Neustadt

[57] ABSTRACT

A dispenser cap for fluid substances, including relatively movable members defining a dispensing hole and an appendix for closing the hole. When the cap is in a closed state, the cap surface in proximity with the dispensing hole is substantially smooth and uniform. When the cap is in a dispensing state, a tubular element in which the hole is provided projects from the surface.

22 Claims, 4 Drawing Sheets

DISPENSER CAP FOR A FLUID SUBSTANCE CONTAINER, WITH A MOVABLE DISPENSING NOZZLE

BACKGROUND OF THE INVENTION

1. Field of the Invention

This invention relates to a dispenser cap for a fluid substance container, of the type which is opened and closed by rotating a rotatable element provided on the outer wall of the cap.

2. Discussion of the Background

Caps of this type have been known for some time, for which reference can be made, for example, to U.S. Pat. Nos. 3,439,843 and 3,809,299, and generally comprise a first element rotatable relative to a second element connected to or formed integrally with said container and comprising at least one aperture for the emergence of the substance to be dispensed. These caps do not, however, ensure a perfect seal between the rotatable and Fixed elements. A further drawback of these caps is that they are difficult to clean.

In this respect portions of the dispensed substance accumulate on their outer surface arid in particular in proximity to their dispensing hole, and which particularly in the case of viscous substances, such as liquid soap, tend to block the hole or in any event form a deposit.

Caps of the aforesaid type are also known comprising a first element to be connected to the neck of a container and having an elongate appendix, the head of which is arranged to cooperate, in order to close the cap, with a dispensing hole provided in a second element rotatable relative to the first.

On rotating said element, said hole moves towards or away from the head of the appendix, so opening or closing the dispensing hole.

Caps of this type are described for example in the patents EP 0187567B1 and FR 2488855.

Said caps solve the sealing problems of the aforedescribed devices.

In the case of the cap described in EP 0187567B1, the diameters of the seal members are, however, such as to generate considerable friction against the rotation of the movable element, particularly if a viscous substance is to flow through the cap.

In addition, neither of said caps solves the initially described cleaning problem.

In this respect, in both caps the substance dispensing hole is provided in the substantially flat upper surface of the cap, on which residues of the dispensed substance tend to accumulate, these residues forming a crust with the passage of time which can block the dispensing hole.

To prevent the dispensed fluid from falling directly onto the outer surface of the cap, it has been proposed to lengthen that portion of the cap comprising the dispensing hole (see for example FIG. 7 of EP patent 0187567B1). This construction is very bulky and in addition makes it difficult to remove any residues of the dispensed substance which flow or are deposited onto the outside of the cap.

SUMMARY OF THE INVENTION

An object of the present invention is to provide a cap of the aforesaid type which is easy to clean while at the same time comprising a dispensing hole which limits accidental deposition of the dispensed substance onto the cap.

A further object is to provide a cap of low cost and simple assembly.

A further object is to provide a dispenser cap of the aforesaid type which discourages the opening (by vandalism, for curiosity or for trying the substance to be dispensed) of the container in the shop, which guarantees to the purchaser that the purchased container has not been opened and therefore contains that quantity of substance with which the container had been filled, and which provides a security seal which is easily removed on opening the cap without the need for special implements.

These and further objects which will be apparent to an expert of the art are attained by a dispenser cap for a fluid substance container, comprising a main body provided with means for its fixing onto the mouth of said container, and a member movable relative to said main body and comprising a hole for the emergence of said substance, there being provided an elongate appendix constrained to said main body and having its free end facing said hole in the movable member so that it becomes inserted into it to form a seal when the cap is in its closed state.

The cap is characterized in that said main body consists of at least two parts which can be securely fixed together and are shaped to define at least one longitudinally extending slot, from the first part of the main body, namely that part to be fixed directly onto the container, there projecting said hollow appendix which has one end open and the other end closed and extends to the center of a hole coaxial therewith and provided in the second part of the main body, said movable member comprising an outer shell and an inner elongate hollow tubular element connected to said shell by at least one arm inserted into and movable within said slot, said tubular element being positioned above said appendix and comprising said hole which is sealedly closable by said free end of the appendix which, in an intermediate region, comprises means for sealing against the opposing cylindrical surface of the cavity in said tubular element, that portion of said appendix positioned above said sealing means having a cross-section which is less than that of the cavity in the tubular element, in said portion there being provided at least one passage for the emergence of said fluid substance, the cross-section and transverse profile of said hole in the second part of the main body being substantially equal to the cross-section and outer profile of said tubular element, the length of said appendix, of said tubular element and of the main body being such that when said movable member is in one end-of-travel position on said main body, said tubular element projects beyond said main body and the hole in the tubular element is free for the outflow of the substance to be dispensed, whereas when in the other end-of-travel position said tubular element is withdrawn into the main body and its exit hole is closed by the free end of said appendix, the outwardly facing surfaces of the tubular element and the adjacent portion of the main body defining a substantially smooth and uniform surface.

Said cap guide slot is of substantially helical extension. In addition, said two parts of the main body of the cap can be locked together by at least one pin projecting from one of said two parts, to be inserted and locked into a hole in the other part.

BRIEF DESCRIPTION OF THE DRAWINGS

The present invention will be more apparent from the accompanying drawings, which are provided by way of non-limiting example and in which:

With reference to FIGS. 1–3 a cap according to the invention comprises a main body 100 (FIG. 1) consisting of two parts 1 and 5, and a member 4 movable relative to said main body.

Figure 1:
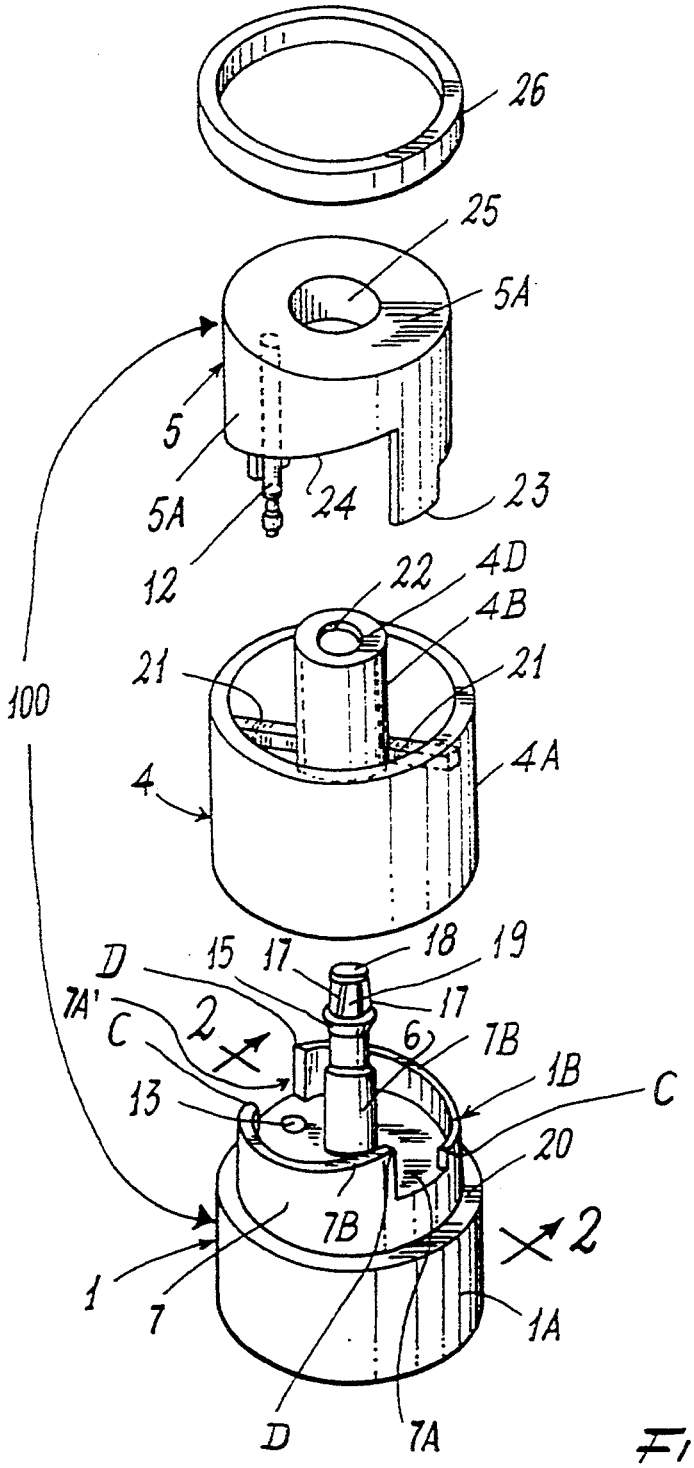
FIG. 1 is an exploded view of a cap according to the present invention.

Specifically, the first part 1 of the main body 100 comprises a lower cup-shaped part 1A to be fixed to the neck of a container 3 (shown by dashed lines in FIGS. 2 and 3) and an upper part 1B of substantially hollow cylindrical shape comprising a central hollow appendix 6 and side walls 7 with two opposing recesses 7A' and free edges 7B having a height which uniformly increases from the base 7A of said upper part 1B.

The internally hollow cup portion 1A comprises along its inner wall a projecting circular rim 9 (FIGS. 2, 3) arranged to penetrate into a groove provided in the container neck 2 and a recessed ring 10 against which the free edge of said neck 2 abuts.

Said inner wall of the cup portion 1A could instead comprise other known means for fixing the closure cap to the container neck, for example a thread could be provided to cooperate with a counterthread present on the neck.

The base 14 of said cup portion 1A comprises (FIGS. 2 and 3) a first central aperture 11 (FIGS. 2 and 3) communicating with the appendix 6, and a second aperture 13 arranged to snap-cooperate with the free end of a pin 12 extending from the second part 5 of the main body 100, so as to constrain this latter to said base.

The outer wall of the appendix 6 comprises in an intermediate position a circular lip or rim 15 of larger diameter than the appendix in order to form a seal against the opposing inner wall 16 of the movable member 4.

In proximity to said seal lip 15 there extend inwards from the appendix 6 four arms 17 (only three are visible in FIGS. 2 and 3) for supporting the free end or head 18, which is of tapering shape in the example.

Figure 3:
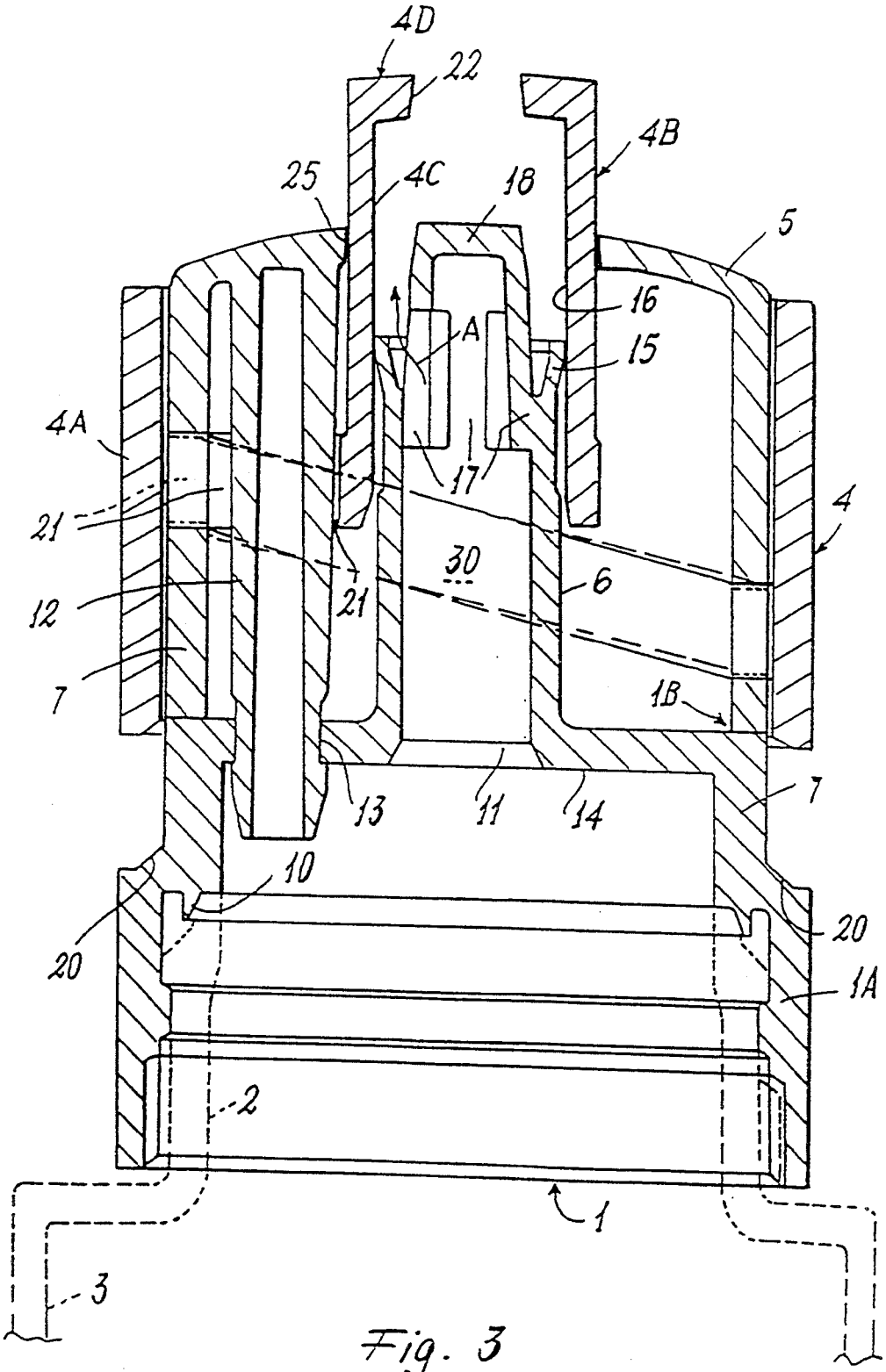

The arms 17 are sized to define between one arm and the next and between the head 18 and the seal lip 15 four apertures 19 (only one is visible in FIG. 1) for the emergence of the substance to be dispensed (the substance flow is indicated by the arrow A in FIG. 3).

The diameter of the cross-section of the appendix 6 comprising said arms 17 is less than the diameter of the opposing cavity of a tubular element 4B of the movable member 4.

In the connecting portion between the lower part 1A and upper part 1B of the main body 100 there is a step 20 against which the lower edge of the movable member 4 abuts.

The free edges 7B (FIG. 1) of the lateral walls 7 of the upper part 1B are shaped to form two tracks of increasing height from the base 7A (FIG. 1), for supporting the arms 21 (FIG. 1) of the movable member 4.

The movable member 4 comprises an outer shell 4A and an inner elongate hollow element 4B connected to said shell by two radial arms 21 inserted into and translationally movable within two slots 30 (FIGS. 2 and 3) of a substantially helical extension defined by the lateral walls 7 and 5A of the two parts 1 and 5 of the main body 100 of the cap.

Figure 2:
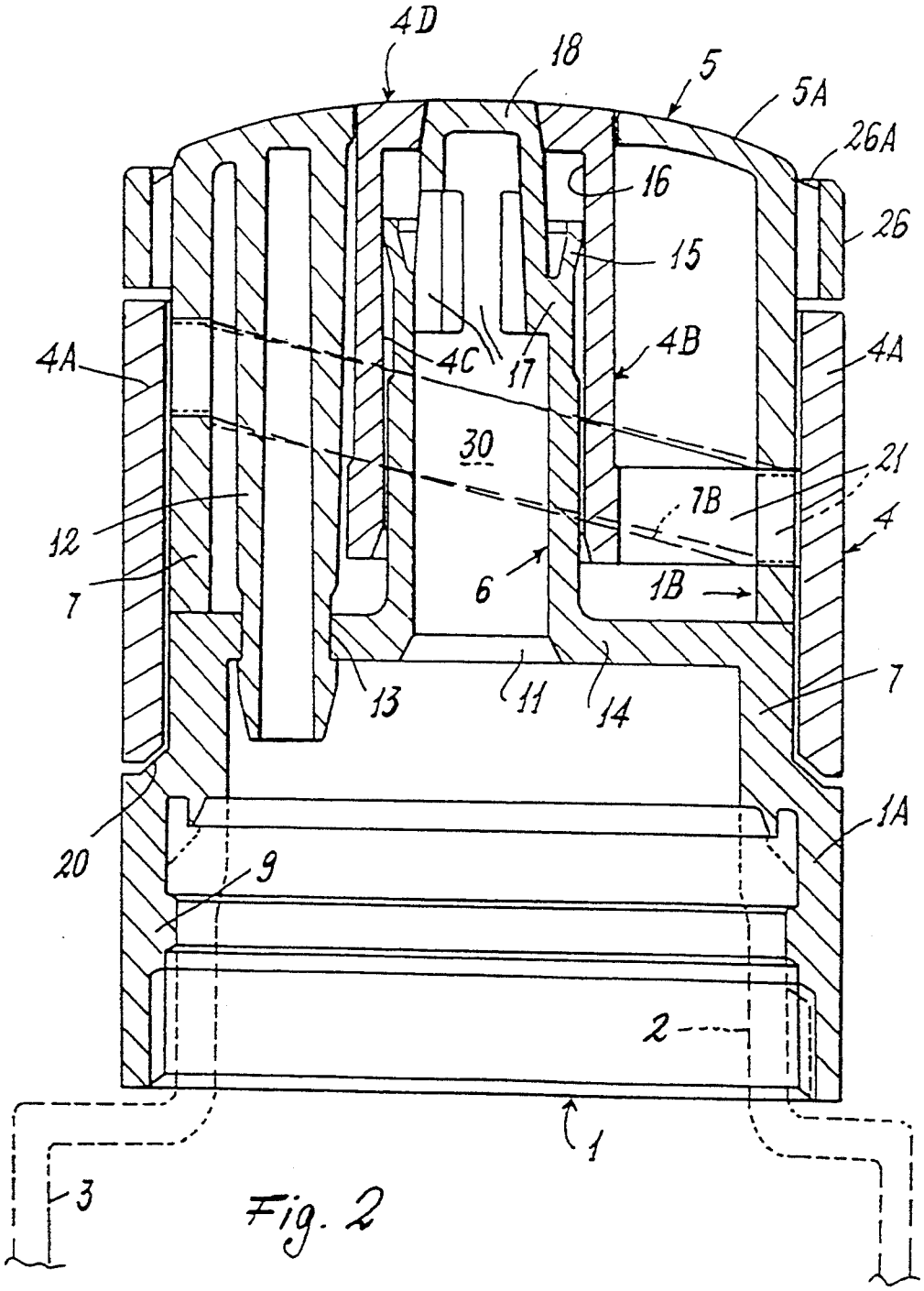
FIGS. 2 and 3 are a sectional view of the cap in its closed position (FIG. 2) and in its open position (FIG. 3) respectively, taken along line 2—2 of FIG. 1.

The tubular element 4B of the movable member 4 comprises in the center of its top 4D a flared hole 22 which is sealedly closed by the head 18 of the appendix 6 when the cap is closed (see FIG. 2). When the cap is opened (see FIG. 3) the substance to be dispensed emerges from the hole 22.

The second part 5 of the main body 100, which is of a substantially hollow cylindrical form, comprises a lateral wall 5A having two portions 23 (only one is visible in FIG. 1) which penetrate into and rest on the edges of the recesses 7A' in the wall 7 of the element 1, and two portions 24 (only one is visible in FIG. 1) having a height which varies uniformly from the top 5A of the element 5.

When the two parts 5 and 1 are joined together, the two portions 24 of variable height define the substantially helical slot 30 (FIGS. 2 and 3) which acts as a guide track for the arms 21 of the member 4. The height of said slot from the base 7A of the part 1 of the main body 100 varies uniformly from a minimum point C (FIG. 1) to a maximum point D.

The top 5A of the second part 5 of the main body 100 comprises a central hole 25 sized so that it can be penetrated by and act as a guide for the tubular element 4B of the movable member 4.

From the top 5A there also extends the pin 12 for joining the two parts 1 and 5 of the main body together. To improve the already good connection between these parts and to prevent any relative rotation between them, one or more additional pins can be provided on one of the two parts analogous to that shown, with corresponding additional seats (13) in the other part to receive the end of the pins.

Other known fixing means (not shown but conventional) can be provided instead of said pins.

The cap of the invention also comprises a security ring 26 which is connected via breakable feet 26A (see FIG. 2) to the upper edge of the element 5 when the cap is in its closed position before being opened for the first time.

On initially opening the cap the part 4 of the cap rises to break the feed 26A and separate the ring 26.

The cap of the invention is assembled and operated as follows.

The movable member 4 is positioned on the first part 1 of the main body 100 with its arms 21 in proximity to the lowest-height point C of the walls 7 of said part 1. The two parts 1 and 5 of the main body 100 are then joined together such that the portions 23 of the walls 5A of the second part 5 rest in the recesses 7A of the first part 1. In this manner the portions 23 stop the travel of said arms 21 in correspondence with the maximum point D and minimum point C of the guide track 7B.

DESCRIPTION OF THE PREFERRED EMBODIMENTS

Assembly of the cap is fast and extremely simple, and can therefore be easily automated.

The cap seal is provided by the lip 15 of the appendix 6 cooperating with the wall 4C of the cavity of the tubular element 4B of the member 4, and by the engagement between the head 18 of the appendix 6 and the hole 22 in said tubular element 4B.

It should be noted that the diameter of the seal lip 15 is extremely small, the friction between the lip and the movable wall 4C of the member 4 being therefore limited so that the latter is easy to rotate.

The cap is opened and closed by rotating the movable member 4. When the cap is closed (see FIG. 2) the hole 22 in the top 4D of the tubular element 4B is sealedly closed by the head 18 of the appendix 6, with the upper walls 5A, 4D and 18 of, respectively, the main body 100, said tubular element 4B and the appendix 6 forming a smooth, uniform, slightly convex surface.

When the cap is opened (see FIG. 3) the tubular element 4B, by virtue of the rotation of the shell 4A to which it is connected, rises relative to the upper wall 5A of the main body 100. In this manner the dispensing hole 22 projects beyond said main body, and when the substance is dispensed (dispensing being achieved by squeezing or inverting the container) there is no soiling of the main body by the dispensed substance.

If the upper wall of the main body 100 is required to be cleaned for some reason, this is particularly simple to effect with the cap of the invention, as said wall has no projecting part when the cap is closed.

A description has been given, with reference to the accompanying drawings, of a preferred embodiment comprising a main body 100 and a movable member 4 movable axially relative to the the main body by virtue of a spirally inclined slot acting as a guide for at least one arm 21 of the movable member. It is, however, apparent that the same axial movement of the movable member can be achieved by any system which enables the movable member to move axially relative to the main body and provides for the stoppage of this latter at two end-of-travel positions in which the hole provided in said movable member for the outflow of the substance to be dispensed is closed and open respectively.

For example the main body and movable member can be joined together by one or more rectilinear grooves substantially parallel to the longitudinal axis of the dispenser cap, and one or more translatable ribs inserted into said grooves, said grooves and ribs being provided on one and respectively the other of the main body and movable member.

Figure 4:
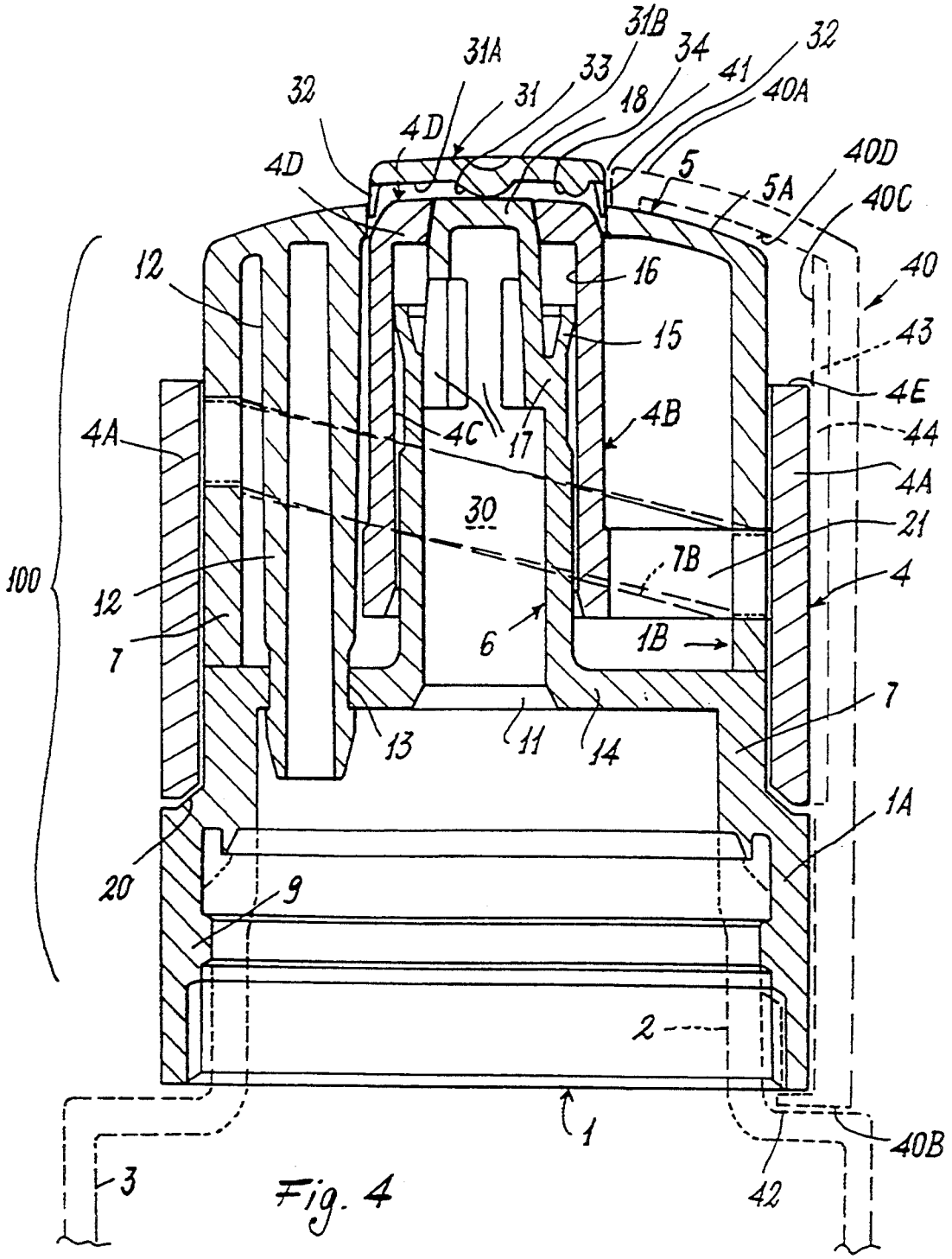
FIG. 4 is a sectional view analogous to that of FIG. 2, but showing a cap with a different security seal.

FIG. 4 shows a modified embodiment of the cap according to the invention and comprises a security seal 31 connected by breakable strips 32 to the part 5 (in FIG. 4, previously described parts carry the same reference numerals).

The seal 31, which is disc-shaped and substantially rigid in the illustrated embodiment, is formed integrally with the second part 5. On that face 31A facing the head 18 of the appendix 6, the seal 31 comprises a projecting rounded portion 33 the bottom of which rests against said head. This makes it impossible for the seal to be accidentally broken by the weight of a container stacked on top of the cap of an underlying container. On the face 31A there is also provided a projection 34 which cooperates with the top 4D of the tubular element 4B when this is moved upwards, so as to result in gradual breakage of the breakable strips 32.

This operation is effected easily and rapidly, by rotating the shell 4A. In this respect, the head 4D of the tubular element 4B rises relative to the edge of the aperture 25 in the part 5 and encounters the projection 34 on the seal 31, so that the thrusting and breakage action of the head 4D is exerted initially only on this projection. The strips 32 connecting the seal to the part 5 are hence not all broken simultaneously but instead one after another in relation to their distance from the projection 34. In this manner the seal can always be broken without having to exert excessive force on the shell 4A and without having to use special implements.

A further modification of the described cap comprises an additional cover 40 (shown dashed in FIG. 4) for the body 100 and member 4, to prevent the seal being able to separate because of an accidental shearing impact.

The cover comprises at its top end 40A an aperture 41 sized to be able to be penetrated by the seal 31, so that when the cover is placed on a cap comprising the seal, the free face 31B of this latter is substantially coplanar with the face 40A of the cover. At its lower edge 40B the cover 40 comprises a rib 42 to enable it to be snap-fitted to the lower edge of the body 100 so that it cannot move axially.

Along that inner face 40C of the cover which faces the shell 4A of the member 4 of the cap, there are provided a plurality of vertical recessed seats 43 in which there engage a plurality of vertical fins 44 provided (in this present embodiment) on that face of the shell 4A facing the cover. In this manner the movable member 4 is rotatably connected to the cover 40, which when rotated also rotates the member 4. This latter can also move axially until its upper edge 4E abuts against the inner face 40D of the cover.

In the cap according to this embodiment, the seal can be connected by breakable strips to the edge of the aperture 41 in the cover 40. Again in this case the seal is broken by the previously described procedure.

I claim:

1. A dispenser cap for a fluid substance container, comprising:

a main body provided with means for fixing of said main body onto a mouth of said container, a member movable relative to said main body and including a hole for dispensing of a substance, an elongate appendix constrained to said main body and having a free end thereof facing said hole in the movable member so that the free end is inserted therein to form a seal when the cap is in a closed state, said main body including at least two parts which are securely fixed together and which are shaped so as to form at least one longitudinally extending slot therebetween, first part and the appendix having one end open and a second end closed and extending to the center of a hole coaxial therewith provided in a second part of the main body, said movable member including an outer shell and an inner elongate hollow tubular element, at least one arm inserted into and movable within said slot for connecting said hollow tubular element to said moveable member, said tubular element being positioned above said appendix and including a hole which is sealable closable by said free end of the appendix which, in an intermediate region thereof, includes means for sealing against an opposing cylindrical surface of a cavity portion of said tubular element, wherein a portion of said appendix positioned above said sealing means has a cross-section which is less than that of the cavity portion in the tubular element wherein in said portion there is provided at least one passage for dispensing of said fluid substance, the cross-section and transverse profile of said hole in the second part of the main body being substantially equal to the cross-section and outer profile of said tubular element, the length of said appendix, of said tubular element and of the main body being such that when said movable member is in one end-of-travel position on said main body, said tubular element projects beyond said main body and the hole in the tubular element is free for outflow of the substance to be dispensed, whereas when in a second end-of-travel position, said tubular element is withdrawn into the main body and the hole in the tubular element is closed by the free end of said appendix, and wherein outwardly facing surfaces of the tubular element and an adjacent portion of the main body define a substantially smooth and uniform surface.

2. A cap as claimed in claim 1, wherein said slot is of a substantially helical extension.

3. A cap as claimed in claim 1, which comprises at least one pin for locking together at least two parts of the main body, said at least one pin projecting from one of said two parts and being inserted and locked into a hole formed in the other part.

4. A cap as claimed in claim 1, wherein said sealing means provided in said intermediate region of said appendix comprises at least one circular lip, a free edge of said lip sealing against the opposing cylindrical surface of the cavity in said tubular element.

5. A cap as claimed in claim 1, wherein said slot extends substantially parallel to the longitudinal axis of said dispenser cap.

6. A cap as claimed in claim 1, which comprises a security seal having a substantially rigid element positioned in correspondence with and above said hole of the second part and connected to said second part by at least one tooth breakable by action exerted on the rigid element by a free end of the tubular element when moved from a closed position to a dispensing position.

7. A cap as claimed in claim 6, wherein from a surface of the breakable element facing the free end of the tubular element at least one first projection is projected on which acts said free end.

8. A cap as claimed in claim 6, wherein from the surface of the breakable element facing the free end of the tubular element, at least one projection is projected for resting against the second end of the hollow appendix.

9. A cap as claimed in claim 6, which comprises a cover placed on said movable member, the cover having a hole located at a position corresponding with the breakable element.

10. A cap as claimed in claim 9, wherein the breakable element is connected to the cover at said hole in the cover.

11. A cap as claimed in claim 6, which comprises a cover connected to the movable member in such a manner as to rotate together therewith, and which is axially constrained to the first part of the main body.

12. A dispenser cap for a fluid substance container, comprising:

a main body provided with a mechanism fixing the main body onto a mouth of the container, a member movable relative to said main body and including a hole for dispensing of a substance, an elongate appendix constrained to said main body and having a free end thereof facing said hole in the movable member so that the free end is inserted therein to form a seal when the cap is in a closed state, said main body including at least two parts which are securely fixed together and which are shaped so as to form a least one longitudinally extending slot therebetween, from a first part of the main body, said appendix projecting from the first part, the appendix having one end open and a second end extending to the center of a hole coaxial therewith provided in a second part of the main body said movable member including an outer shell an inner elongate hollow tubular element, at least one arm inserted into and movable within said slot for connecting said hollow tubular element to said movable member, said tubular element being positioned above said appendix and including a hole which is sealably closable by said free end of the appendix which, in an intermediate region thereof, includes a mechanism sealing against an opposing cylindrical surface of a cavity portion of said tubular element wherein a portion of said appendix positioned above said sealing mechanism has a cross-section which is less than that of the cavity portion in the tubular element wherein in said portion there is provided at least one passage for dispensing of said fluid substance, the cross-section and transverse profile of said hole in the second part of the main body being substantially equal to the cross-section and outer profile of said tubular element, the length of said appendix of said tubular element and of the main body being such that when said movable member is in one end-of-travel position on said main body, said tubular element projects beyond said main body and the hole in the tubular element is free for outflow of the substance to be dispensed, whereas when in a second end-of-travel position said tubular element is withdrawn into the main body and the hole in the tubular element is closed by the free end of said appendix and wherein outwardly facing surfaces of the tubular element and an adjacent portion of the main body define a substantially smooth and uniform surface.

13. A cap as claimed in claim 12, wherein said slot is of a substantially helical extension.

14. A cap as claimed in claim 12, which comprises at least one pin for interlocking together at least two parts of the main body, said at least one pin projecting from one of said two parts and which is inserted and locked into a hole formed in the other part.

15. A cap as claimed in claim 12, wherein said sealing mechanism provided in said intermediate region of said appendix comprises at least one circular lip, a free edge of which seals against the opposing cylindrical surface of the cavity in said tubular element.

16. A cap as claimed in claim 12, wherein said slot extends substantially parallel to the longitudinal axis of said dispenser cap.

17. A cap as claimed in claim 12, which comprises a security seal having a substantially rigid element positioned in correspondence with and above said hole of the second part and connected to said second part by at least one tooth breakable by action exerted on the rigid element by a free end of the tubular element when moved from a closed position to a dispensing position.

18. A cap as claimed in claim 17, wherein from a surface of the breakable element facing the free end of the tubular element, at least one first projection is projected on which acts said free end.

19. A cap as claimed in claim 17, wherein from the surface of the breakable element facing the free end of the tubular element, at least one projection is projected for resting against the second end of the hollow appendix.

20. A cap as claimed in claim 17, which comprises a cover placed on said movable member the cover having a hole located at a position corresponding with the breakable element.

21. A cap as claimed in claim 20, wherein the breakable element is connected to the cover at said hole in the cover.

22. A cap as claimed in claim 17, which comprises a cover connected to the movable element in such a manner as to be able to rotate together therewith, and which is axially constrained to the first part of the main body.

* * * * *